US006467382B2

(12) United States Patent
Willits et al.

(10) Patent No.: US 6,467,382 B2
(45) **Date of Patent: *Oct. 22, 2002**

(54) EXTRACTOR FOR EXTRACTING CUT PARTIALLY CUT PARTS FROM A SHEET OF MATERIAL

(75) Inventors: Samuel P. Willits, Barrington; Thomas E. Kleeman, Elgin; William W. Wilk, Rockford; Baesley I Dahlstrom, Des Plaines, all of IL (US)

(73) Assignee: Spartanics, Rolling Meadows, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/498,665

(22) Filed: Feb. 7, 2000

(65) Prior Publication Data

US 2001/0048015 A1 Dec. 6, 2001

(51) Int. Cl.[7] ..... B26D 7/18; B26F 3/02; B31B 1/96

(52) U.S. Cl. ..... 83/27; 83/29; 83/88; 83/103; 225/5; 225/96.5; 225/104; 493/342

(58) Field of Search ..... 83/103, 29, 25, 83/89, 86, 88, 27; 225/103, 104, 1, 2, 4, 5, 93, 94, 96, 96.5; 493/342, 373

(56) References Cited

U.S. PATENT DOCUMENTS

| | | | | | |
|---|---|---|---|---|---|
| 2,655,842 | A | | 10/1953 | Baumgartner | |
| 3,526,163 | A | * | 9/1970 | Lowery | 83/103 X |
| 3,889,863 | A | | 6/1975 | Deslauriers | |
| 3,948,020 | A | | 4/1976 | Deutsch et al. | |
| 4,033,240 | A | * | 7/1977 | Deslauriers | 83/103 X |
| 4,047,474 | A | | 9/1977 | Lang | |
| 4,096,981 | A | | 6/1978 | Martorano | |
| 4,109,842 | A | | 8/1978 | Aquilla | |
| 4,467,948 | A | | 8/1984 | Deslauriers | |
| 4,515,321 | A | * | 5/1985 | Kahlman | 225/4 X |
| 4,529,114 | A | * | 7/1985 | Casper et al. | 225/4 X |
| 4,606,534 | A | * | 8/1986 | Gombault | 225/5 X |
| 4,618,085 | A | * | 10/1986 | Kimura et al. | 225/4 X |
| 4,727,784 | A | * | 3/1988 | Sarka et al. | 83/88 X |
| 4,851,075 | A | * | 7/1989 | Parker | 225/93 X |
| 4,948,025 | A | * | 8/1990 | Lisec | 225/104 |
| 4,969,640 | A | * | 11/1990 | Littleton | 83/88 X |
| 5,101,747 | A | * | 4/1992 | Gerber | 83/103 X |
| 5,141,142 | A | * | 8/1992 | Ramsey | 225/4 |
| 5,193,423 | A | * | 3/1993 | Bakker | 83/88 X |
| 5,197,938 | A | | 3/1993 | Chmielewski | |
| 5,219,108 | A | | 6/1993 | Mineki | |
| 5,427,294 | A | * | 6/1995 | VandenHeuvel et al. | 225/4 |
| 5,470,004 | A | | 11/1995 | Mineki | |
| 5,540,369 | A | * | 7/1996 | Boreali et al. | 225/4 |

FOREIGN PATENT DOCUMENTS

| | | | | |
|---|---|---|---|---|
| GB | 1377443 | * | 12/1974 | 83/103 |

* cited by examiner

*Primary Examiner*—Charles Goodman
(74) *Attorney, Agent, or Firm*—Thomas R. Vigil; Welsh & Katz, Ltd.

(57) ABSTRACT

An extraction apparatus for extracting or separating cut or partially cut pieces or parts from a cut sheet at an extraction station comprises: a sheet gripping and moving device for gripping and moving a cut or partially cut sheet through an extraction station; and an extraction roller at the extraction station positioned for movement transversely of a cut sheet and being constructed, arranged and operated to move transversely of the path of movement of the cut sheet when the leading edge scrap web of the cut sheet is adjacent the extraction roller to engage and deflect the scrap web of the cut sheet passing through the gripping and moving device away from the cut pieces or parts.

8 Claims, 3 Drawing Sheets

EXTRACTOR FOR EXTRACTING CUT PARTIALLY CUT PARTS FROM A SHEET OF MATERIAL

BACKGROUND OF THE INVENTION

1. Field of the Invention

The present invention relates generally to the extraction or separation of cut or partially cut pieces or parts from a sheet of material, having the pieces or parts cut into the sheet by various methods such as, steel rule die, male female tooling, laser, traveling knife and water jet.

2. Description of the Prior Art

In the converting industry, and in particular in the flat stock blanking and die cutting industry, it is a common requirement to separate cut parts from the sheet, web or blank from which the parts have been cut. Various methods are used to effect this separation.

In low volume operations, it is a common practice to separate the parts from the sheet or web manually, i.e., the sheet or web is twisted and the parts are poked out by hand to break the parts out of the scrap matrix and drop them in a collection vessel. The requirement for manual labor, the slowness of the process and the inability to maintain part sequence are deficiencies in this commonly used separation method.

In higher volume cutting operations, it is common practice to position the recently cut sheet or web in a knock-out station, wherein male/female knock out members are actuated to blank or knock the parts out of the sheet or web and onto a catch table. The scrap matrix is then removed from the blanking or knock-out station and discarded. Knock-out stations effectively remove parts from the scrap matrix, but their shape is job specific requiring a uniquely contoured male/female blanking or knock-out station for each cut line pattern. A second deficiency of knock-out stations, in particular for sheet processing, is their inability to shingle the parts in a shingle stack after knocking them out. This is because sheet edges are used to position sheets in the knock-out station and thus the entire sheet must be blanked or knocked out at one time. The inability to shingle stack parts makes the processing of sequential parts, such as membership cards, impractical with a knock out procedure, and the parts collection process, in general, clumsy.

Another method used to separate the scrap matrix from parts, are rotating "stripper pin wheels". In this method, rotating wheels equipped with barbed pins are positioned directly below the scrap web. As the material moves, the barbed pins penetrate the scrap web of the web or sheet continuously revolving to pull away the scrap. The parts keep moving straight ahead, while the scrap is pulled down and away from the parts. Once the scrap web, sheet or blank is pulled below the parts, the scrap web is scraped off the barbed pins, and dropped into a scrap bin. A shortcoming of this method is that relatively soft material into which the barbed pins can penetrate is required. Moreover, although scrap that runs parallel to the material feed direction can be stripped away, scrap cross bars (scrap or trim running perpendicular to the material feed direction) cannot be stripped away.

Heretofore various analogous and non-analogous systems and structures for extracting cut or partially cut parts from a sheet, web or blank have been proposed. Examples of previously proposed part extractors are disclosed in the following U.S. patents:

| U.S. Pat. No. | Patentee |
|---|---|
| 2,655,842 | Baumgartner |
| 3,889,863 | Deslauriers |
| 3,948,020 | Deutsch et al. |
| 4,047,474 | Lang |
| 4,096,981 | Martorano |
| 4,109,842 | Aquilla |
| 4,467,948 | Deslauriers |
| 5,197,938 | Chmielewski |
| 5,219,108 | Mineki |
| 5,470,004 | Mineki |

The Baumgartner U.S. Pat. No. 2,655,842 discloses a deflector plate for deflecting downwardly the waste sheet from a sheet of die cuts.

The Deslauriers U.S. Pat. No. 3,889,863 discloses an edge roller and a deflector plate for deflecting a die cut sheet.

The Deutsch et al. U.S. Pat. No. 3,948,020 teaches a roller-shaped deflector or looping element. When a lever is pivoted counterclockwise, as shown in FIG. 2 or FIG. 3 of this patent, the deflector moves to a second position and causes a running web to form a loop in order to facilitate the replacement of the running web with a fresh web.

The Lang U.S. Pat. No. 4,047,474 discloses a stripping station for removing waste portions which are apparently removed by a punching operation or a suction operation. Then, a leading edge portion is engaged by a gripping bar.

The Martorano U.S. Pat. No. 4,096,981 discloses an apparatus for stripping a continuous web of material from the marginal edge of a body. The stripping apparatus includes a pivotable deflecting plate located above the path of movement of the continuous web for deflecting the trim from the die cut piece surrounding a die cut piece in the web and directing it toward a pair of separating rollers which then pull the trim downwardly.

The Aquilla U.S. Pat. No. 4,109,842 discloses projection structures for engaging a side edge of a die cut sheet and moving it downwardly, as best shown in FIG. 3 of this patent.

The Deslauriers U.S. Pat. No. 4,467,948 teaches a stripping belt, as best shown in FIG. 6 of this patent, for engaging and removing trimmed waste from a die cut sheet.

The Chmielewski U.S. Pat. No. 4,197,938 teaches a similar stripping belt for removing a waste portion of a die cut sheet.

The separating apparatus in the Mineki U.S. Pat. Nos. 5,219,108 and 5,470,004 teaches a press roller that rotates around the circumference of a rotation roller to separate a scrap web from a cut part and a separation helping plate.

SUMMARY OF THE INVENTION

It is an object or feature of the present invention to provide a new and improved extraction system for separating cut or partially cut parts from a sheet.

Another object or feature of the present invention is to extract parts in such a manner that parts can be deposited and shingle stacked onto a conveyor.

Yet another object or feature of the present invention is to maintain the sequence of the sequentially formed products or parts subsequent to the extraction of the parts from a sheet.

A still further object or feature of the present invention is to extract parts of different shapes and sizes and different material thickness, rigidity and sizes without the need for adjustment of stripping or guiding fingers or knock-out elements specific to each part shape and size.

The foregoing and other objects or features of the invention are obtained with the method and apparatus described below.

In one preferred embodiment of the apparatus of the present invention there are provided input nip rollers which receive and drive cut sheets and an extraction roller which, when actuated, bends down the leading edge margin of a scrap web of a cut sheet around the circumference of the lower driven input nip roller, which sheet is otherwise held tangent to the nip point of the input nip rollers, with sufficient radius to cause the cut parts to separate from the scrap web, and which input rollers and extraction roller, as the driven input nip rollers drive the sheet, cause the cut parts, separated by the bend radius, to pass over the extraction roller and the remaining scrap web to pass between the extraction roller and the lower input nip roller. If desired, output nip rollers are positioned to receive the leading edge of the cut parts as the cut parts are separating from the scrap web to drive the cut parts along a line essentially tangent to the nip point of the input nip rollers and to assist in removing the cut parts from the sheet while transporting and depositing the parts in sequence onto a surface, such as a conveyor, in a shingle stacked manner.

As used herein, nip or nip point means the line of contact between adjacent nip rollers where the nip rollers engage and grip a sheet of material.

The apparatus may include motors, circuitry and software to time and actuate the functions of the nip rollers and the extraction roller. Alternately, the apparatus may be actuated manually such as with a foot pedal and hand crank.

DESCRIPTION OF THE PREFERRED EMBODIMENT(S)

Figure 1:
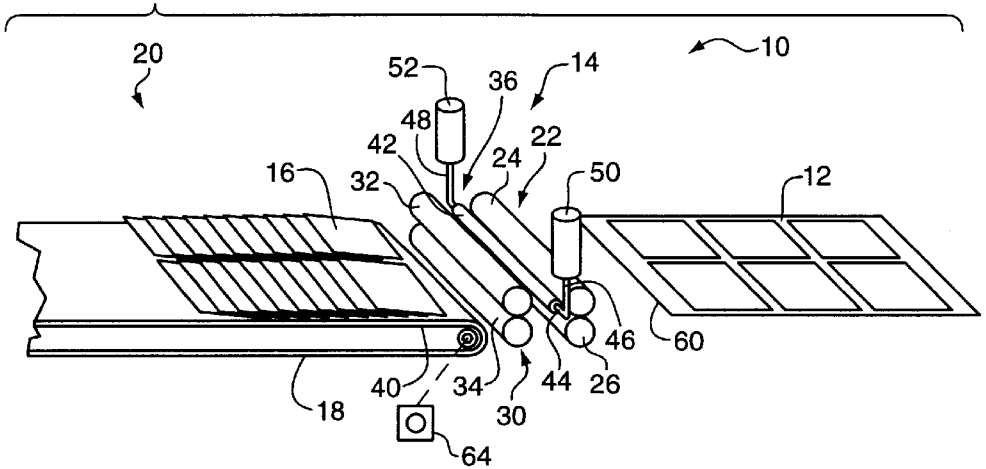
FIG. 1 is a perspective block schematic drawing of an extraction apparatus for separating cut or partially cut pieces or parts from a cut sheet and shows the cut sheet about to enter an extraction apparatus where cut pieces or parts are separated from the sheet and subsequently passed on to a conveyor in a shingle stacked manner.

Referring now to the drawings in greater detail, there is illustrated schematically in FIG. 1 an extraction apparatus 10 for extracting or separating from a cut or partially cut sheet 12 at an extraction station 14, cut or partially cut pieces or parts 16 and for passing the pieces or parts 16 onto a conveyor 18 at a receiving station 20.

The cut or partially cut sheet 12 is fed by conventional sheet moving apparatus, e.g., a conveyor or sheet feeder, not shown, from right to left, as shown in FIG. 1 toward the extraction station 14 comprising nip rollers 22 and extraction roller apparatus 36, including an extraction roller 42.

Figure 2:
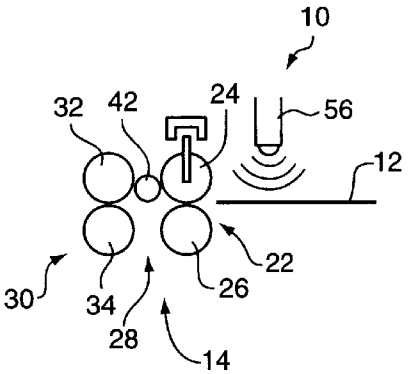
FIG. 2 is a side elevational view of the apparatus shown in FIG. 1 and shows a sheet sensor positioned above a cut sheet before it enters input nip rollers.

As shown in FIG. 2, in its at rest or quiescent position, the extraction roller 42 is located adjacent and behind the upper roller 24 of the input nip rollers 22 comprising nip rollers 24 and 26. Also as shown in FIG. 2, an optional sensor 56 senses the position of cut sheet 12 as it approaches the extraction station 14. Alternately, a separate device, such as an automatic sheet feeder or a person hand-loading sheets in the extraction apparatus 10 may control sheet position in the extraction station 14 and trigger the extraction sequence by an electronic or mechanical device, not shown.

The sensor 56 may be used to tell a system controller 57 the position of the sheet 12, by which signal a controller may close and activate the input nip rollers 22 activate and deactivate the extraction apparatus 36 and open and deactivate the input nip rollers 22. In the absence of sensor 56, separate material positioning and material position detecting means, not shown, such as a sheet feeder or a person hand-loading, may control sheet position in the extraction apparatus 10 and activate, operate and deactivate sheet gripping and moving mechanisms devices 22 and 36 when sheet 12 is positioned and ready for the extraction sequence described below.

According to the teachings of the present invention, the extraction apparatus 36 illustrated in the drawings includes the roller 42 freely mounted for rotation on a shaft 44 having upturned lower ends 46 and 48 defining first and second piston rods or armatures 46 and 48 which are received in first and second cylinders 50 and 52 or solenoids 50 and 52 or mechanical levers 50 and 52 which are actuated to move the extraction roller 42 up or down.

Figure 4:
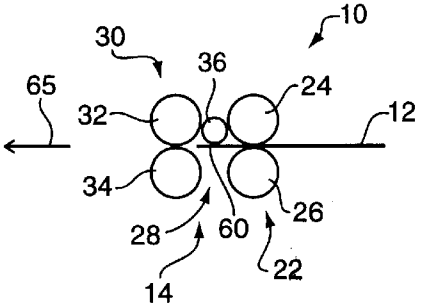
FIG. 4 is a side, elevational view of the apparatus shown in FIG. 3 and shows a cut sheet between input nip rollers with a margin at a leading edge of a scrap web of the sheet under an extraction roller.
Figure 3:
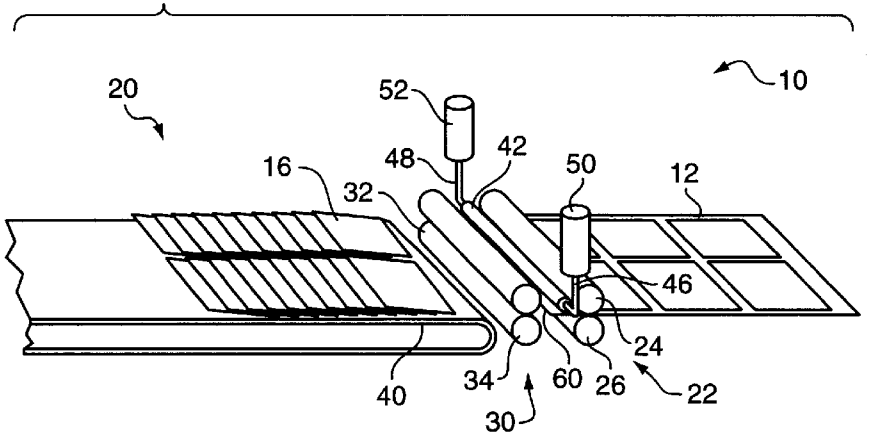
FIG. 3 a perspective block schematic drawing of the apparatus shown in FIG. 1 and shows a cut sheet after it has been positioned between input nip rollers.

As illustrated in FIGS. 3 and 4, the cut or partially cut sheet 12 is ready for the extraction of cut or partially cut parts 16. The extraction begins with the insertion of a leading edge margin 60 of a scrap web 62 of the sheet 12 beneath the extraction roller 42 in space 28, and sheet 12 gripped and held tangent to the nip point of nip rollers 22 along tangent line 65.

Figure 6:
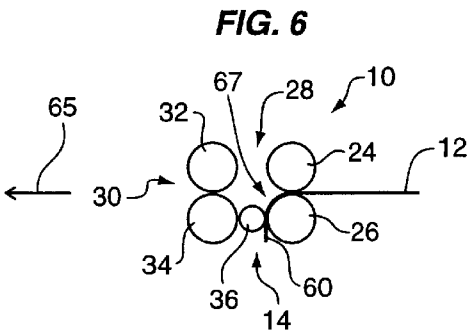
FIG. 6 is a side elevational view of the apparatus shown in FIG. 5 and shows the leading edge margin of the scrap web of a cut sheet directed downwardly by an extraction roller which extraction roller forms a nip between the extraction roller and the lower one of the:put nip rollers (extraction nip), the remainder of the sheet being held tangent to a line tangent to the nip point of the input nip rollers, and an extraction roller being supported by a lower one of output nip rollers to which it is coincident.
Figure 5:
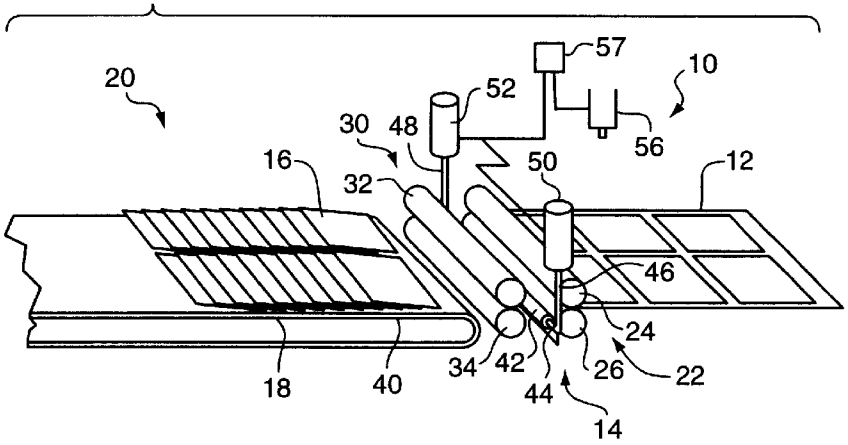
FIG. 5 is a perspective block schematic view of the apparatus shown in FIG. 1 and shows an extraction roller after it has moved downwardly against the leading edge margin of the scrap web of a cut sheet for initiating extraction of the cut pieces or parts from the cut sheet.

Under these conditions, as shown in FIGS. 5 and 6, the extraction sequence continues by actuating mechanisms 50 and 52 to cause the shaft end rods 46 and 48 to move the extraction roller 42 into engagement with the leading edge margin 60 of the scrap web 62 of the cut sheet 12 and bend the leading edge margin 60 of the scrap web of sheet 12 around the circumferential surface of lower input nip roller 26. After the extraction roller 42 moves down, it is located below tangent line 65 of input nip rollers 22 in the space 28, and forms a nip point 67 between extraction roller 36 and lower nip roller 26 which grips the scrap web 62 of sheet 12.

Figure 8:
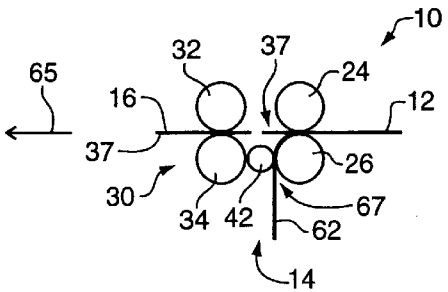
FIG. 8 is a side elevational view of the apparatus shown in FIG. 7 and shows the scrap web, waste or trim of a cut sheet, minus the cut pieces or parts, being driven downwardly by an extraction nip formed between the lower one of the input set of nip rollers and the extraction roller that has moved to a position adjacent the lower input nip roller, and the scrap web, waste or trim of the cut sheet being bent around the circumference of the lower input nip roller by the right angle juxtaposition of the input nip and the extraction nip and guided and driven downwardly by the gripping and driving of the extraction nip, and the cut pieces or parts, being held tangent to the nip point of the input nip rollers and being driven by the input nip rollers along a path tangent to the nip point of the input nip rollers, entering and being driven through the output nip rollers whose nip point is essentially tangent with the nip point of the input nip rollers and onto a conveyor.
Figure 7:
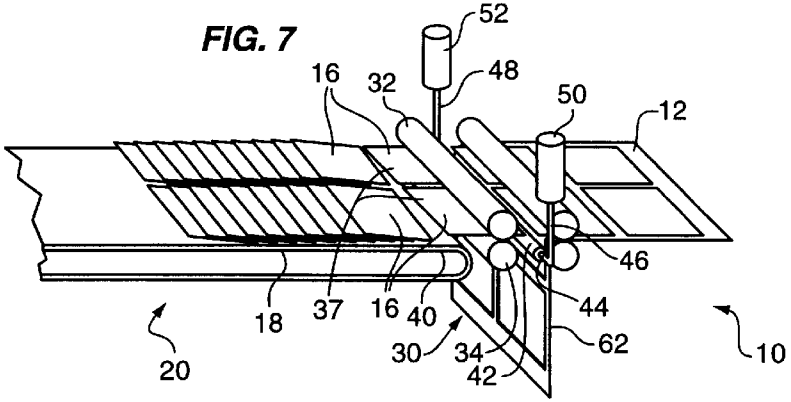
FIG. 7 is a perspective block schematic view of the apparatus shown in FIG. 1 and shows input nip rollers holding the cut parts tangent to the nip point of the input nip rollers (input nip), an extraction roller directing the scrap, waste or trim of a cut sheet downwardly to extract the cut pieces or parts from the cut sheet with the cut pieces traveling forwardly to a second, driven set of output nip rollers which receive and pull cut pa from the scrap web and guide the parts onto a conveyor.

Then, as shown in FIGS. 7 and 8, the extraction of the parts 16 from the scrap, waste or trim portion 62 of the cut sheet 12 is accomplished by maintaining a grip on sheet 12 at the nip point of input nip rollers 22 and by maintaining a grip on scrap web 62 at extraction nip 67 and then driving input nip rollers 22 to drive sheet 12 to the left (as shown in FIG. 8) through nip rollers 22 and to drive scrap web 62 down and through nip point 67. It is by the grip of input nip rollers 22, keeping cut parts 16 coincident to tangent line 65 and by the essentially 90 degree juxtaposition of the nip point of the input nip rollers 22 and extraction nip 67 to the circumferential surface of the lower input nip roller 26 that separation of parts 16 from sheet 12 and the extraction of parts 16 from scrap web 62 is accomplished.

Figure 10:
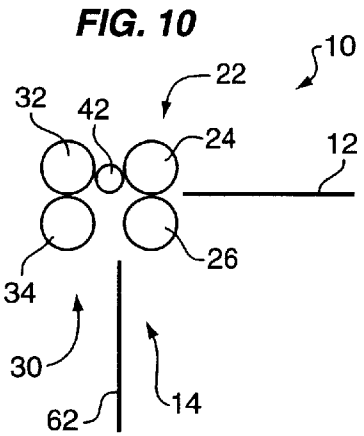
FIG. 10 is a side elevational view of the apparatus shown in FIG. 1 and shows the falling scrap web, waste or trim of the cut sheet with the input nip rollers and the extraction roller ready to receive a subsequent cut sheet.
Figure 9:
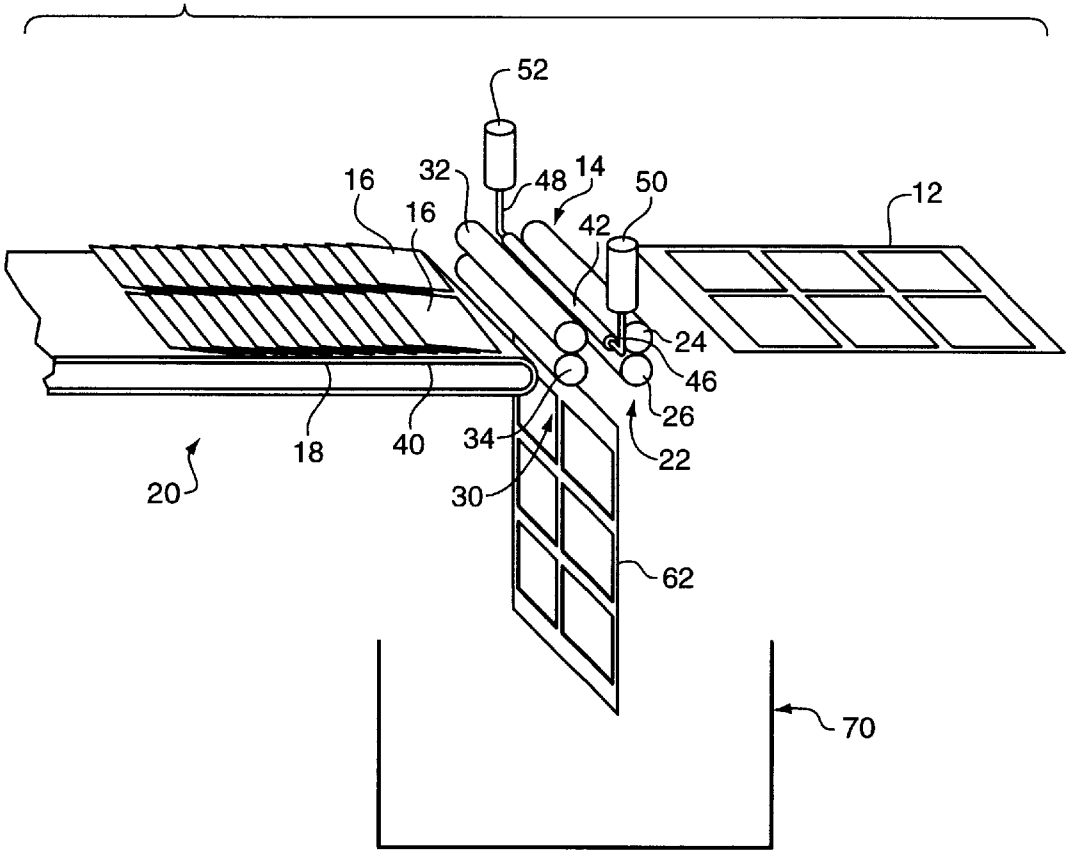
FIG. 9 is a perspective block schematic view of the apparatus shown in FIG. 1 and shows the cut pieces after they have completely passed through the output nip rollers and onto a conveyor and stacked in a shingle stacked manner with the scrap, waste or trim of the cut sheet falling to a collection station below the extraction station, and shows the extraction roller in its raised position, as previously shown in FIG. 1, ready to receive a subsequent cut sheet.

As shown in FIGS. 9 and 10, this process will continue until all of the scrap, waste or trim 62 of the cut sheet 12 has passed between and exited input nip rollers 22 and extraction nip 67 to a scrap collection station 70 located beneath the extraction station 14 for receiving the scrap, web or trim 62 and all parts 16 have passed between input nip rollers 22 and exited to the left side of input nip rollers 22 and over extraction nip 67.

After a time, for example when a cut sheet 12 is no longer sensed by sensor 56, or after a preset time, for example 2 seconds, or when an operator releases a pedal, the pistons, solenoids or mechanical levers 50 and 52 actuate to retract the end rods 46 and 48 to move the extraction roller 42 to its initial position behind the upper roller 24, as shown in FIGS. 1 and 9, 2 and 10.

Optional output nip rollers 30, herein illustrated as nip rollers 32 and 34, FIG. 2, may be located to the output side of input nip rollers 22 and to the left, as viewed in FIG. 2 of extraction roller 42, with the nip point of nip rollers 32 and 34 being essentially coincident to tangent line 65. This optional output set of nip rollers 30 grabs leading edge 37, FIG. 8, of each piece or part 16 that has been separated from sheet 12 by extraction station 14 and by the driving action of nip rollers 30 helps to pull the pieces or parts 16 from sheet 12.

The cut parts 16 and scrap web 62 separating function of extraction station 14 depends on a rigid, non-bending extraction roller 42 that evenly grips and bends down the leading edge margin 60 of sheet 12 and remains unbending as the nip point between extraction roller 42 and input nip roller 26 drives the scrap web 62 down and away from the cut parts 16. The lower roller 34, optionally may be situated to support and prevent extraction roller 42 from flexing even if extraction roller 42 is of a length and diameter such that extraction roller 42 would otherwise, without the support from roller 34, flex. This feature enables use of a small diameter extraction roller 42 which in turn permits output nip rollers 30 to be situated closer to input nip rollers 22 than would otherwise be possible. As a consequence of the narrow space 28 between input nip rollers 22 and output nip rollers 30, sheets 12 of thinner and more flexible material and smaller pieces or parts 16, that need only have a dimension that is greater than the distance along path 65 between the nip points of input nip rollers 22 and output nip rollers 30, can be driven by input nip rollers 22 across space 28 to output nip rollers 30 without parts 16 drooping or falling below the nip point of output nip rollers 30.

Optionally, after the cut pieces or parts 16 have moved along path 65 through space 28 to output nip rollers 32 and 34, the cut or partially cut pieces or parts 16, which are separating from the cut sheet 12, are engaged and pulled by the output set 30 of nip rollers 32 and 34, as shown in FIGS. 7 and 8, through output nip rollers 30 and onto the entry end 40 of conveyor 18 at the receiving station 20. Conveyor 18 may advance at various speeds via speed control and timing means 64 and may be timed with the extraction apparatus 10 to yield widely spaced to closely spaced shingled or stacked parts 16, with or without batch spaces. Alternately, where parts 16 sequencing is not needed, the parts 16 may simply fall into a catch bin, not shown.

It will be understood that the extraction roller 42 will stay in the position shown in FIGS. 9 and 10 until a subsequent cut sheet 12 is moved into the space 28 as shown in FIG. 1, whereupon the process as described above and shown in FIGS. 1–10 will repeat.

From the foregoing description, it will be understood that the extraction apparatus 10 of the present invention has a number of advantages, some of which have been described above and others of which are inherent in the invention. For example, the extraction apparatus 10 of the present invention can handle multiple parts per sheet and material of various thickness and rigidity; and it can handle parts of various sizes and shapes. Further, the extraction roller 42 of the present invention can move up and down, either fast or slow, with various amounts of force and be of various sizes and textures.

Also, from the foregoing description, it will be apparent that modifications can be made to the extraction apparatus 10 of the present invention without departing from the teachings of the invention. For example, the extraction apparatus 10 of the present invention can have a separate device to control the cut sheet 12 prior to extraction, namely, to deliver the cut sheet 12 to the extraction station 14 and trigger the gripping and moving device 22, namely, nip rollers 24 and 26 and the extraction roller 42 to bend the leading scrap edge 60 of the cut sheet 12 without using a sensor 56. Also, different textures and hardness of the nip rollers or other gripping and moving devices, such as belts, can be used in place of the pairs 22 and 30 of nip rollers.

Accordingly, the scope of the invention is only to be limited as necessitated by the accompanying claims.

We claim:

1. A method for extracting cut and partially cut parts from a cut sheet in an extraction apparatus comprising the steps of: gripping and moving the cut and partially cut parts and sheet through drivable input nip rollers that hold the cut sheet and parts coincident to a line tangent to a nip point of the input nip rollers; positioning an extraction roller to an output side of the input nip rollers and moving the extraction roller arranged for movement transversely of the line tangent to the nip point of the input nip rollers from a position above this tangent line to a lower position below this tangent line when a leading edge scrap margin of the cut sheet, the scrap margin being part of a scrap web of the cut sheet, is below the extraction roller for engaging and deflecting the leading edge scrap margin of the cut sheet and forming an extraction nip between the extraction roller and a lower one of said input nip rollers and gripping and bending and driving the scrap web of the cut sheet passing through the input nip rollers and the extraction nip away from the line tangent to the nip point of the input nip rollers, whereby the scrap web, by the driving of said input nip rollers and extraction nip is bent around a circumferential surface of the lower input nip roller between the nip point of the input nip rollers and the extraction nip and driven downwardly through the extraction nip; and the cut parts, by being held tangent to the nip point of the input nip rollers and by the driving of the input nip rollers pass above the extraction roller and through the input nip rollers, and by these steps, separating the cut and partially cut parts from the cut sheet.

2. The method of claim 1 including the additional step of receiving, gripping and transporting cut parts, driven into driven output nip rollers by the input nip rollers, said output nip rollers being positioned to the output side of the input nip rollers and extraction roller and said output nip rollers having a nip point essentially tangent to the line tangent to the nip point of the input nip rollers, through the output nip rollers and away from the input nip rollers.

3. The method of claim 2 including the step of supporting the extraction roller with a lower one of the output nip rollers to prevent flexing of the extraction roller.

4. The method of claim 2 including the further step of sensing a position of the cut sheet and using the position of the sheet sensed by a sensing means to move said extraction roller when the leading edge margin of the scrap web of the cut sheet is below said extraction roller and to activate and deactivate the input nip rollers, extraction roller and output nip rollers.

5. An extraction apparatus for extracting cut and partially cut parts from a cut sheet comprising: drivable input nip rollers for gripping and moving the cut and partially cut parts and sheet through the input nip rollers and for holding the cut sheet and parts coincident to a line tangent to a nip point of the input nip rollers; and an extraction roller positioned on an output side of said input nip rollers and arranged for movement transversely of the line tangent to the nip point of the input nip rollers from a position above this tangent line to a lower position below this tangent line and means for moving said extraction roller transversely of this tangent line when a scrap margin adjacent a leading edge of the cut sheet, the scrap margin being part of a scrap web of the cut sheet, is below said extraction roller to engage and to deflect the leading edge scrap margin of the cut sheet and to form an extraction nip between said extraction roller and a lower one of said input nip rollers to grip and drive the scrap web of the cut sheet passing through said input nip rollers and the extraction nip away from the line tangent to the nip point of the input nip rollers, whereby the scrap web, by the driving of said input nip rollers and extraction nip is bent around a circumferential surface of the lower input nip roller between the nip point of the input nip rollers and the extraction nip and driven downwardly through the extraction nip; and the cut parts, by being held tangent to the nip point of the input nip rollers and by the driving of said input nip rollers, separate from the scrap web and pass through the input nip rollers and over said extraction roller.

6. The extraction apparatus of claim 1 further comprising driven output nip rollers positioned to the output side of said input nip rollers and extraction roller, and with a nip point of these output nip rollers being essentially tangent to the line tangent to the nip point of the input nip rollers for receiving, gripping, pulling and transporting cut parts driven into the output nip rollers by the input nip rollers through the output nip rollers and away from the input nip rollers.

7. The extraction apparatus of claim 6 wherein a lower one of the output nip rollers is positioned to support the extraction roller to prevent flexing of the extraction roller.

8. The extraction apparatus of claim 6 further comprising sensing means for sensing a position of the cut sheet and means for using a signal from said sensing means to trigger movement of said extraction roller when the leading edge margin of the scrap web of the cut sheet is below said extraction roller and to activate and deactivate said input nip rollers, said extraction roller and said output nip rollers.

* * * * *

UNITED STATES PATENT AND TRADEMARK OFFICE

CERTIFICATE OF CORRECTION

PATENT NO. : 6,467,382 B2
DATED : October 22, 2002
INVENTOR(S) : Willits et al.

It is certified that error appears in the above-identified patent and that said Letters Patent is hereby corrected as shown below:

Title page,
Item [73] Spartanics, Rolling Meadows, IL (US)" should be -- [73] Spartanics, Inc., Rolling Meadows, IL (US) --

Column 3,
Line 63, change "the: put" to -- the put --;

Column 4,
Line 8, change "cut pa" to -- cut parts --;

Column 8,
Line 32, change "claim 1" to -- claim 5 --.

Signed and Sealed this

Twenty-fourth Day of June, 2003

JAMES E. ROGAN
*Director of the United States Patent and Trademark Office*